United States Patent [19]

Walega

[11] Patent Number: 4,939,805

[45] Date of Patent: Jul. 10, 1990

[54] HEEL LASTER

[75] Inventor: William Walega, Hollis, N.H.

[73] Assignee: International Show Machine Corporation, Nashua, N.H.

[21] Appl. No.: 365,396

[22] Filed: Jun. 13, 1989

[51] Int. Cl.[5] ..... A43D 21/16; A43D 21/00

[52] U.S. Cl. ..... 12/10.5; 12/12; 12/12.5

[58] Field of Search ..... 12/12, 12.3, 12.5, 10, 12/10.5, 14.4, 8.5, 7

[56] References Cited

U.S. PATENT DOCUMENTS

| | | | |
|---|---|---|---|
| 3,255,475 | 6/1966 | Ralphs | 12/14.4 |
| 3,256,543 | 6/1966 | Ralphs | 12/14.4 |
| 3,868,737 | 3/1975 | Fichtner et al. | 12/12 |
| 4,404,700 | 9/1983 | Berrill et al. | 12/12 |
| 4,653,133 | 3/1987 | Giebel | 12/10.5 |
| 4,654,914 | 4/1987 | Leeper | 12/12.5 |
| 4,679,269 | 7/1987 | Becka et al. | 12/10.5 |
| 4,728,378 | 3/1988 | Bianchi | 12/12 |

*Primary Examiner*—Steven N. Meyers
*Attorney, Agent, or Firm*—Robert Shaw

[57] ABSTRACT

A heel laster to receive a footwear upper assembly and constructed to press, form and last the heel part of the footwear upper assembly. A structure is provided to secure the assembly to the laster; princers stretch the heel part of the upper about the heel region of the last; and a heel pad presses the upper against the last. Then a nozzle is moved and positioned by a mechanical structure along an appropriate adhesive path. The mechanical structure includes a tracer mechanism the includes an adjustable U-shaped cam track and a linkage connected to the nozzle at one end and to a cam follower at the other end thereof such that the cam follower is positioned within the cam track; a driver mechanism is connected to propel the cam follower along the track in the X-Y directions (the nozzle can move in the Z-direction as well to follow contours of the footwear). The heel pad is preferably an inflatable pad. The mechanical tracer mechanism, as a unit, has a predetermined and fixed position relative to the heel pad. The heel laster operates in two steps: first, the pad is pressed against the heel of the upper and, second, the pad is inflated to press into any crevices a the upper surface at the heel region (and the shank region). Then the upper is wiped onto the insole of the assembly.

11 Claims, 12 Drawing Sheets

HEEL LASTER

BACKGROUND OF THE INVENTION, INCLUDING FIELD OF THE INVENTION

The present invention relates to a machine to last the heel region of a shoe or other footwear upper.

Attention is called to U.S. Pat. No. 4,660,242 (Vornberger et al) wherein there is disclosed an activator for heating and shaping the heel portion of a shoe upper (in this specification reference is made mostly to shoes, but the invention has relevance to footwear more broadly), the heel portion being heated and then stretched about a mold having a back portion approximately the ultimate shape of the shoe heel portion. The heated upper is, then, typically transferred to a heel molder flanger (HMF) of the type shown in U.S. Pat. No. 4,709,433 (Walega) and the further a prior art cited (e.g., the bulletins of record). The heel molder flanger has a cooled mold to receive the heated upper whose back portion approximates the ultimate shape of the heel of the ultimate shoe. The word "approximates" is emphasized here, because the mold of the HMF is used for many, many different shoe styles and shapes, as well as left shoes and right shoes; hence, in most cases it is only near to the shape of the last which corresponds to the ultimate shape of the finally-fabricated shoe. The industry long has sought a way to form the heel portion of the shoe upper to the exact shape of the ultimate shoe.

A heel molder to fulfill these requirements is disclosed in an patent application Ser. No. 278,983 filed Dec. 2, 1988 (Becka et al), which is a CIP of Ser. No. 186,417 filed Apr. 26, 1988. The present invention, on the other hand, is directed to heel lasting, rather than heel molding, per se. The system herein disclosed performs, generally, the functions disclosed in the Becka et al application Ser. No. 278,983, but it performs, as well, lasting, that is, adherence of a footwear margin onto the outer surface of an insole, which insole typically is disposed on and secured to a last.

See U.S. Pat. No. 4,679,269 (Becka et al) and art cited therein for a heel laster.

OBJECTIVES OF THE INVENTION

Accordingly, it is an objective of the present invention to provide a heel laster that serially forms the heel portion of the shoe upper to the exact contour of the ultimately fabricated shoe for varying sizes and styles, as well as left shoes and right shoes, and then lasts the shoe upper, that is, adheres the upper to the insole of a footwear upper assembly.

The foregoing is a non-trivial problem, but according to the present teaching another benefit of the invention results: the upper is both formed about and lasted upon the last on which the shoe will be lasted and finally fabricated. Hence, according to modern fabricating techniques, the product, the shoe, will be less costly to fabricate— again a non-trivial matter.

A further objective of the invention is, then, to provide a machine that reduces the cost of shoe fabrication.

The heel portion of a shoe upper typically includes a thermally-activated material, that is, a material that becomes flexible when heated above some threshold temperature and becomes relatively—and sharply—rigid below that temperature. It is rigid at and below room temperatures. The present machine is intended to receive the shoe upper when the material is flexible, to form the flexible heel portion to the ultimate shape thereof, to maintain that shape while the thermally-activated material is changing from flexible to rigid in character, and to last the upper at this juncture.

A still further objective, then, is to provide a machine that receives the heated shoe upper draped about a last and forms the heel and shank region of the shoe upper about the heel and shank region of the last to the exact form that the heel and shank region will take, while withdrawing enough heat from the thermally-activated material for the latter to become rigid and therefore fixed in shape. Then the upper is lasted.

Contouring of the heel portion of the upper in all shoe styles and types is important—women's shoes in particular — but it must be recognized that such contouring encompasses shaping of more than the back of the shoe; it most particularly includes producing a substantially flat heel seat with a clearly-defined edge, that is, the border between the heel seat (which is in the flat heel plane, the X-Y plane herein) and generally the plane of the sides of the shoe upper (i.e., the Y-Z plane herein, approximately). Contouring includes forming the upper about the heel and shank region of the last smoothly, despite sharp surface changes in the last and thickness changes in the upper at the heel and shank region.

Another objective of the invention is to provide a machine that can fashion the heel portion of the shoe upper to a shape that exhibits a flat heel seat, a well-defined edge between the heel seat and the adjacent proximate sides of the upper and smooth sides at the heel and shank region.

These and still further objectives are addressed hereinafter.

SUMMARY OF THE INVENTION

The foregoing objectives are achieved, generally, in a heel laster to receive a footwear upper assembly that includes a last, a footwear upper draped about the last and an insole disposed on the last bottom, the heel laster being adapted to press and form the heel part of the footwear upper assembly about the heel and side parts of the last, the heel part of the upper typically having a margin that extends outwardly from the insole, the heel part of the upper including a material which can be deformed and will take a preformed set, the heel laster including a mechanism to achieve mechanical attachment of the last to the machine; pincers positioned to grasp the upper at its toe or forepart region and operable to draw the upper in the toe direction of the footwear upper assembly to stretch the heel part of the upper—which has typically been heated by an activator or the like (see the Vornberger et al.'242)—about the heel portion of the last; a heel pad adapted to apply pressure to form or shape the shoe upper about the heel portion of the last and the shank portion thereof; wipers operable, while the pad is in clamping engagement of the footwear upper assembly, to wipe the upstanding margin of the upper onto the insole at the last bottom, whereby the heel portion of the upper, including, usually, the thermally-activated material and other upper parts adhere to each other as a laminate to take a permanent preformed set; and a bedding mechanism that is operable to apply high bedding pressure between the wiped margin, disposed between the insole and the wipers, to overcome remnant or residual mechanical memory of the upper to achieve sharp molding definition, i.e., a sharp edge between the side of the upper and the wiped margin thereof. The heel laster includes a mechanical structure positioned to apply adhesive onto the insole in the heel region thereof; the mechanical structure includes a nozzle (or other adhesive emitter) and a mechanical tracer mechanism to position the nozzle (or other adhesive emitter) appropriately with respect to the insole. The mechanical tracer mechanism includes a pivotally adjustable U-shaped cam track, a linkage connected to the nozzle at one end thereof and to a cam follower at the other end thereof such that the cam follower is positioned within the cam track. A driver (e.g., air cylinders) is connected to propel the cam follower along the track in the X-Y directions (that is, directions in the X-Y plane). The nozzle is movable in the Z-direction to cause it to follow undulations in the X-Y plane. The mechanical tracer mechanism, as a unit, has a predetermined and fixed position relative to the heel pad of the heel laster (but that fixed position can be fine tuned). Wipers are provided to wipe the margin of the upper assembly onto the insole thereof.

BRIEF DESCRIPTION OF THE DRAWINGS

The invention is hereinafter discussed with reference to the accompanying drawing in which.

DETAILED DESCRIPTION OF THE PREFERRED EMBODIMENTS(S)

Figure 1:
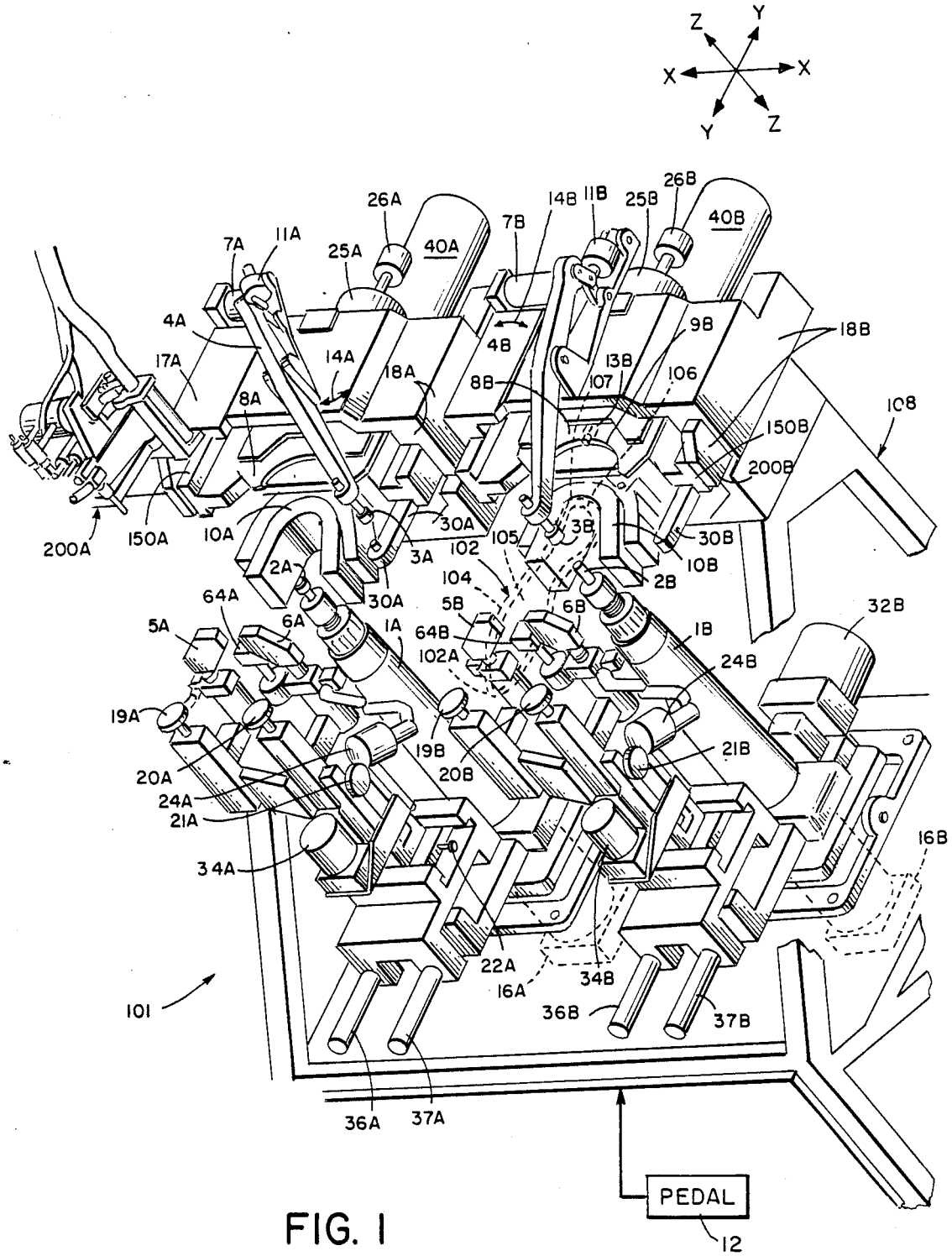
FIG. 1 is an isometric view of a machine, partly diagrammatic in form, that embodies the inventive concepts herein, including in some detail an adhesive applicator that includes a U-shaped cam track and related parts, some parts being in phantom and partly cutaway.

Turning now to the drawing, there is shown at 101 in FIG. 1 a heel laster to receive a footwear upper assembly 102 that includes, a last 103, a footwear upper 104 draped about the last 103(FIGS. 6A–6C) an insole 105 disposed on the last bottom, the heel laster 101 being adapted to form the heel part 106 having a margin 107(FIGS. 6A–6C) that extends outwardly or upwardly from the insole 105, forming of the heel being effected, in part, by a heel pad 10B(10A). The heel part, as is common in the industry, typically includes a thermally-activated material that is deformable when heated above a threshold temperature and is relatively non-deformable below the threshold temperatures. The thermally-activated material is rigid (in the context of this disclosure) at room temperature; and it usually has a thermally-activated adhesive at each surface thereof.

The operator is intended to stand in front of the machine 101 looking in the plus Y-direction. Directions extending toward the operator (i.e., minus Y-direction) will be designated as "forward" and directions extending away from the operator will be designated as "rearward." The front of the machine is closest to the operator and the back of the machine is furthermost from the operator. Furthermore, the plus-minus Y-direction movements are not horizontal, even though implicitly indicated to be such. They are rather at about forty-five degrees to the horizontal from "forward" to "rearward", but their tilt is only for convenience. In this specification plus-minus Y-direction, that is, forward and rearward movements of the machine parts, may be horizontal, but are usually at an angle to the horizontal. Another matter is addressed at this juncture.

As later noted herein, the machine 101 includes a spindle 1B(1A). (The heel lasting machine 101 is a two-station machine; mechanisms on the left side thereof are like mechanisms on the right side thereof. In this specification the letter A indicates a machine part at the left side of the machine 101 and the letter B indicates a machine part at the right side of the machine: e.g. the spindle 1B(1A).) The spindle 1B(1A) is similar to a spindle in the side and heel lasting machine of U.S. Pat. No. 4,553,281 (Vornberger) and its predecessor patents which discuss holdown features of the spindle and a lock of the spindle which may be released during wiping to apply bedding pressure between wipers and the upper at the margin thereof. (See, also, the Becka et al. '269 patent for a spindle that applies bedding pressure.) The Vornberger '281 patent and its predecessors, as here, include a mechanism which deposits an adhesive into the region between the margin and the insole.

The heel laster 101 includes the spindle 1B(1A) which includes a last pin 2B(2A), in FIG. 1, that is typically received by a recess in the last 103, as is well known. Also, typically, the machine 101 includes a holdown mechanism 3B(3A) which, as later discussed, serves to establish a wiping plane. The holdown mechanism 3B(3A) also serves to press the last firmly on the spindle 1B(1A) and the toe support (or rest) 64B(64A). The holdown mechanism 3B(3A), according to the present teaching, is pivoted by an air cylinder 7B(7A) from a standby position into a position slightly spaced above the insole 105 by swinging or rotating an arm 4B(4A)—see arrow 14B(14A)—from the standby position to a position slightly spaced above (plus Z-position) from the insole 105. Swinging or rotating the arm 4B(4A) from the standby position to a position slightly spaced from the insole reduces travel distance and hence achieves faster movement from position-to-position thereof. The swinging action is effected by the pivot air cylinder 7B(7A) through an appropriate mechanical linkage; an air cylinder 11B(11A) pivots the holddown toward the assembly 102. The arm 4A swings counterclockwise to the position in FIG. 1, the standby position, and the arm 4B swings clockwise so as not to interfere with the nozzle structure.

As noted above, the holdown 3B(3A) presses the last 103 firmly onto the spindle 1B(1A). At that point, pincers 5B(5A) and 6B(6A), which are positioned to grasp the upper 104 at its toe or forward region 102A and are operable to draw the upper 104 in the toe and upward direction of the footwear upper assembly (i.e., minus Y-direction) to stretch the heel part of the upper 104 about the heel part 106 of the last 103, perform that function. At this juncture in shoe formation, the heel pad 10B(10A) moves forward and is closed about the heel and shank part of the footwear upper assembly; adhesive is applied in the heel region (and often the shank region) of the upper assembly. Wipers 8B(8A) and 9B(9A) move forward and pivot closed to wipe the margin 107 onto the insole 105.

Figures 4, 4A:
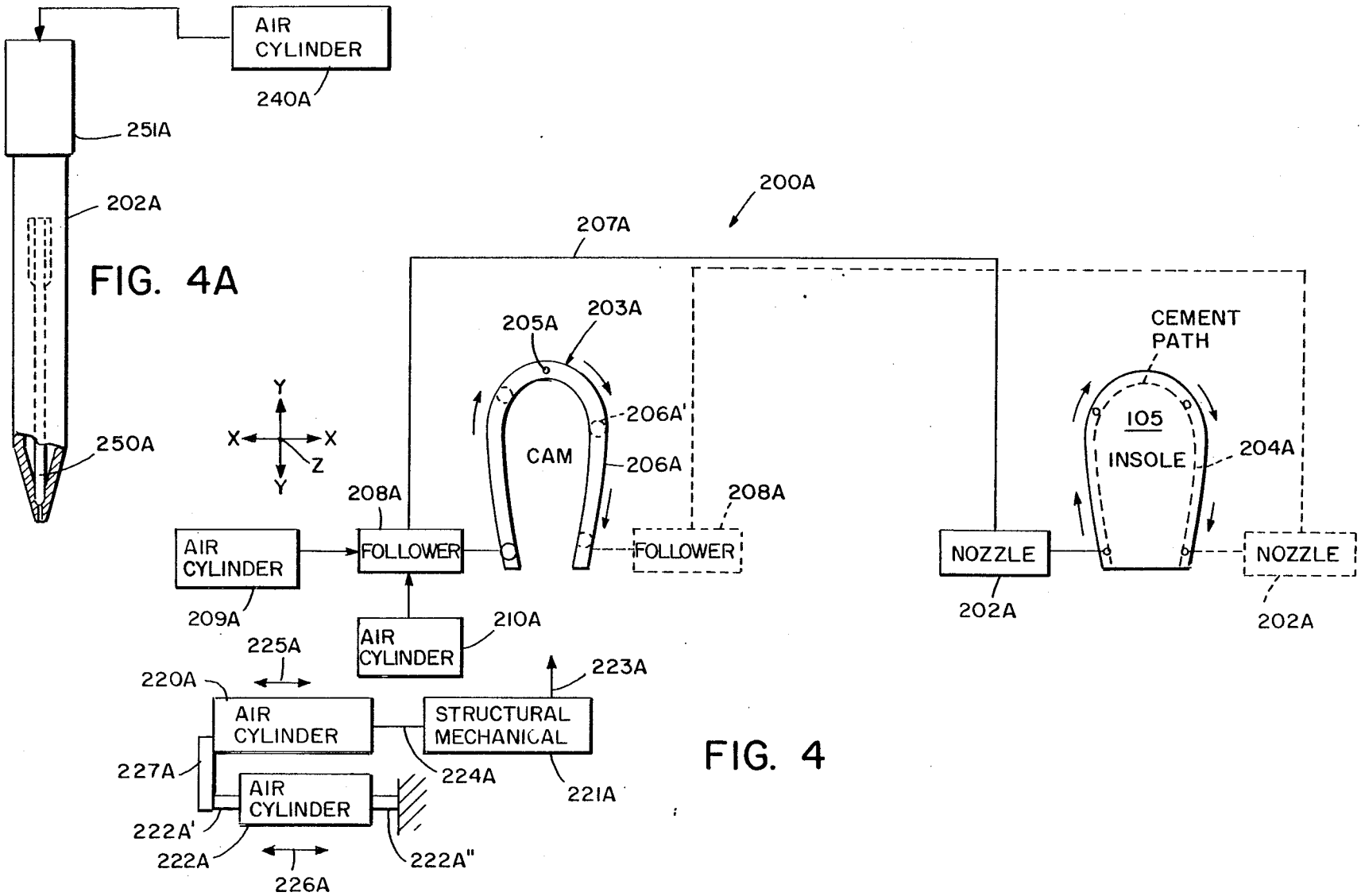
FIG. 4 is a diagrammatic showing of the mechanical adhesive applicator in FIG. 1, showing, for example, the U-shaped cam track, a U-shaped adhesive path, and a structure coupling the two.
FIG. 4A is an elevation view, partly cutaway and partly diagrammatic in form of a nozzle.
Figure 5A:
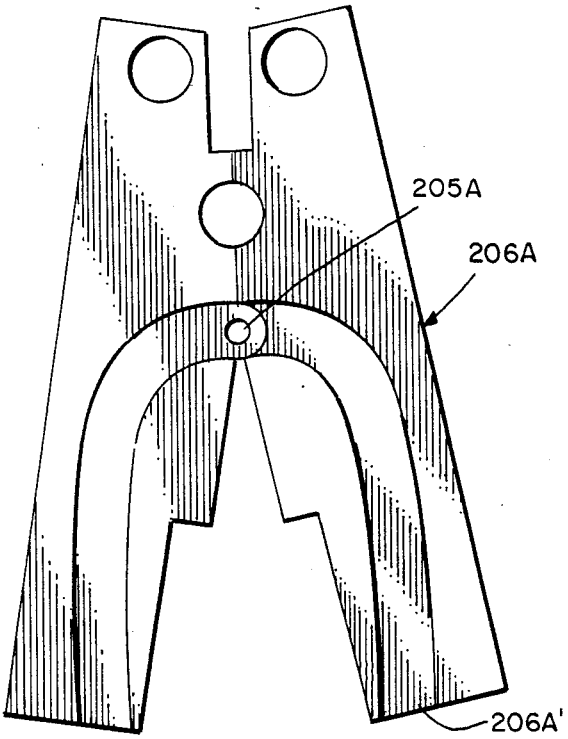
FIGS. 5A and 5B show in top plan view a cam with the U-shaped cam track and FIGS. 5C and 5D show a bottom plan view of the same cam, to show a pivoting aspect of the cam.
Figure 5B:
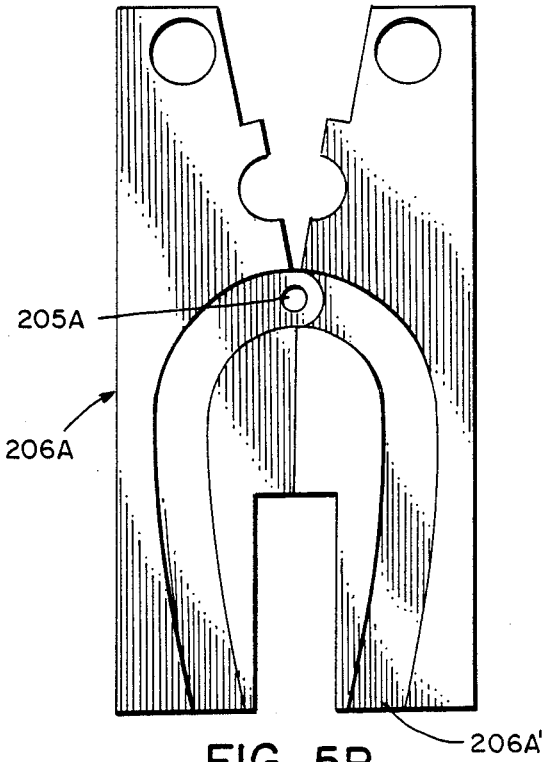
Figure 5C:
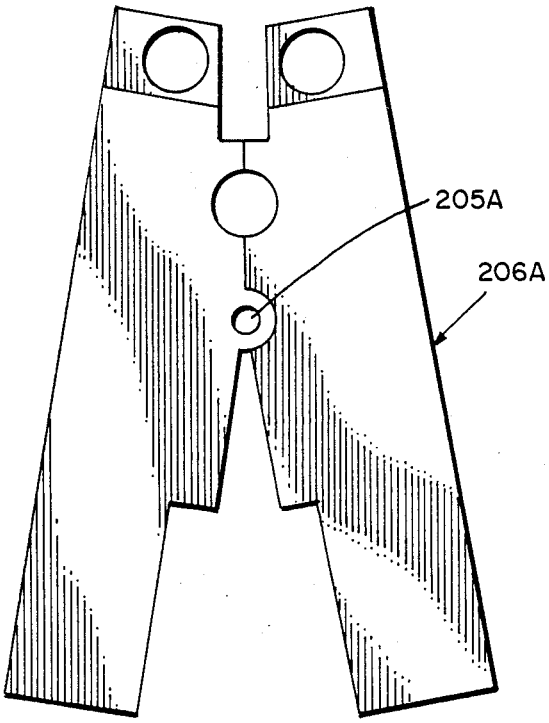
Figure 5D:
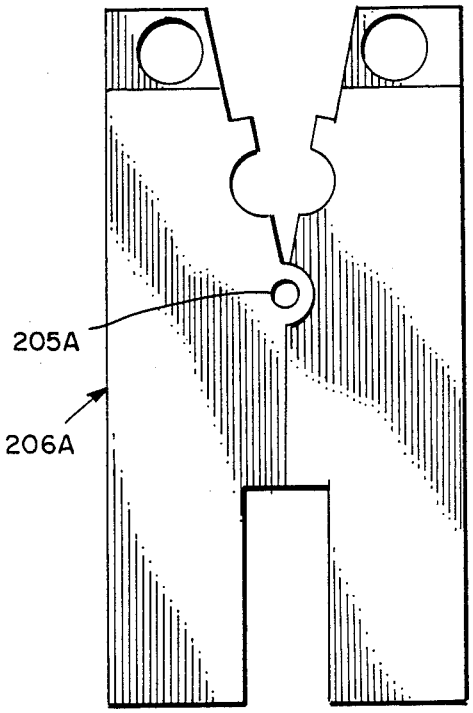

The machine of the present invention differs most markedly from the machine in the Becka et al. application in that the present machine includes a mechanical applicator structure 200A(200B) in FIG. 4 (only 200A is shown in FIG. 4) to apply an adhesive ribbon 204A or the like (the right ribbon is not shown in the figures) onto the insole at the heel region thereof. The mechanical structure 200A (200B) is attached to the remaining parts of the machine 101 by an attachment 150A (150B), in FIG. 1 directly connected to slide 17A (18B). The mechanical structure 200A(200B) includes a nozzle (or other adhesive emitter) 202A in FIGS. 4 and 4A. (Only the left-hand elements of the adhesive applicator are shown here in any detail. The right-hand elements are like the left hand elements.) The structure 200A includes, also, a tracer mechanism 203A to position the nozzle 202A and to guide the nozzle 202A along an appropriate adhesive applicator path 204A. The mechanical tracer mechanism 203A includes a pivotally (i.e., pivotal at 205A) adjustable U-shaped cam track 206A' (of the cam 206A), see FIGS. 5A–5D, to accommodate different sizes and styles of shoe, a linkage 207A connected to the nozzle 202A at one end thereof and to a cam follower 208A at the other end thereof such that the cam follower 208A is positioned within the cam track 206A'. Drivers (e.g., air cylinders such as cylinders 209A and 210A) are connected to propel the cam follower 208A along the U-shaped cam track 206A' in the X-Y directions. Most importantly, the mechanical structure 200A, including the tracer mechanism 203A (as a unit), has a predetermined and fixed geometrical position relative to the heel pad of the heel laster and hence to the heel region of the insole 105, as shown in FIG. 4. Said differently, a significant problem in any applicator of adhesive into the heel region of a shoe upper assembly, and onto the outer surface of the insole thereof, is positioning the always U-shaped ribbon pattern 204A accurately along the longitudinal axis of the shoe upper assembly. According to the present teaching, for any thickness of heel pad at the curvilinear rearmost region (i.e., the back of the heel), once that thickness is fed into the various leverages which can be adjusted mechanically, then the mechanical structure 200A always positions the nozzle 202A to a predetermined location in the plus/minus Y-direction and in the X-Y which is substantially parallel to the shin insole at the heel part thereof plane.

For present purposes, the present inventor has found that positioning of the nozzle 202A in the plus/minus X-direction also has some important considerations. If the adhesive nozzle is first presented too close to the upper margin, it may, in some situations, press downward upon the upstanding margin. Thus, in the present system, the mechanical structure 200A is operable to place the nozzle 202A initially toward the longitudinal axis (plus/minus Y-direction in FIGS. 1 and 6A) of the footwear upper assembly, is operable thereafter to lower the nozzle 202A toward (but slightly removed from) the insole 105, FIG. 6B, and is operable thereafter to move the nozzle outward (i.e., the plus/minus X-direction) toward the edge of the footwear upper assembly to apply an adhesive ribbon there and beneath the margin 107. See FIG. 6C. Hence, for present purposes, the nozzle 202A is first presented near (or slightly removed from) the insole 105 toward the longitudinal axis of the insole; then the nozzle is lowered toward—but slightly removed from—the insole; and then the nozzle 202A is moved radially outward toward the edge of the insole. Thereafter it is moved along the U-shaped path to deposit adhesive along a U-shaped path onto the insole, near the edge thereof. Typically, and preferably, the adhesive is applied as a ribbon onto the outer surface of the insole at the heel part (and shank) of the insole, but the adhesive may be applied onto the outwardly extending margin or in and about the apex of the angle between the outwardly extending margin and the insole outer surface; all such surfaces are included herein by the language "in the region between the margin and the insole", and like terms herein.

The linkage 207A in FIG. 4 used to move the nozzle 200A along the cement path 204A is a panagraph assembly which couples the forces from the cam track, follower, etc., to the nozzle 202A. This form of drive is often used in the shoe machine industry and needs no further description.

A point that is noted before is elaborated upon here. The mechanical structure 200A(200B), including the tracer mechanism 203A, moves as a unit in the plus/minus Y-direction together with the pad 10A(10B) which is also U-shaped. The thickness of the pad 10A(10B) at the neck (i.e., the curved byte region between the legs of the U) establishes the deposition plus/minus Y-direction of the adhesive ribbon, or the like, onto the insole. Corrections can be made for any mispositioning in the plus/minus Y-direction due to variations in the Y-direction thickness of the pad, but these will ordinarily be small. Hence, the plus/minus Y-direction positioning of the nozzle 202A presents no problem in the context of the present invention (although that is an important issue with some prior art machines). The present inventive concepts solve the Y-direction positioning of the nozzle 202A relative to the heel region of the footwear upper assembly quite nicely.

Figure 8:
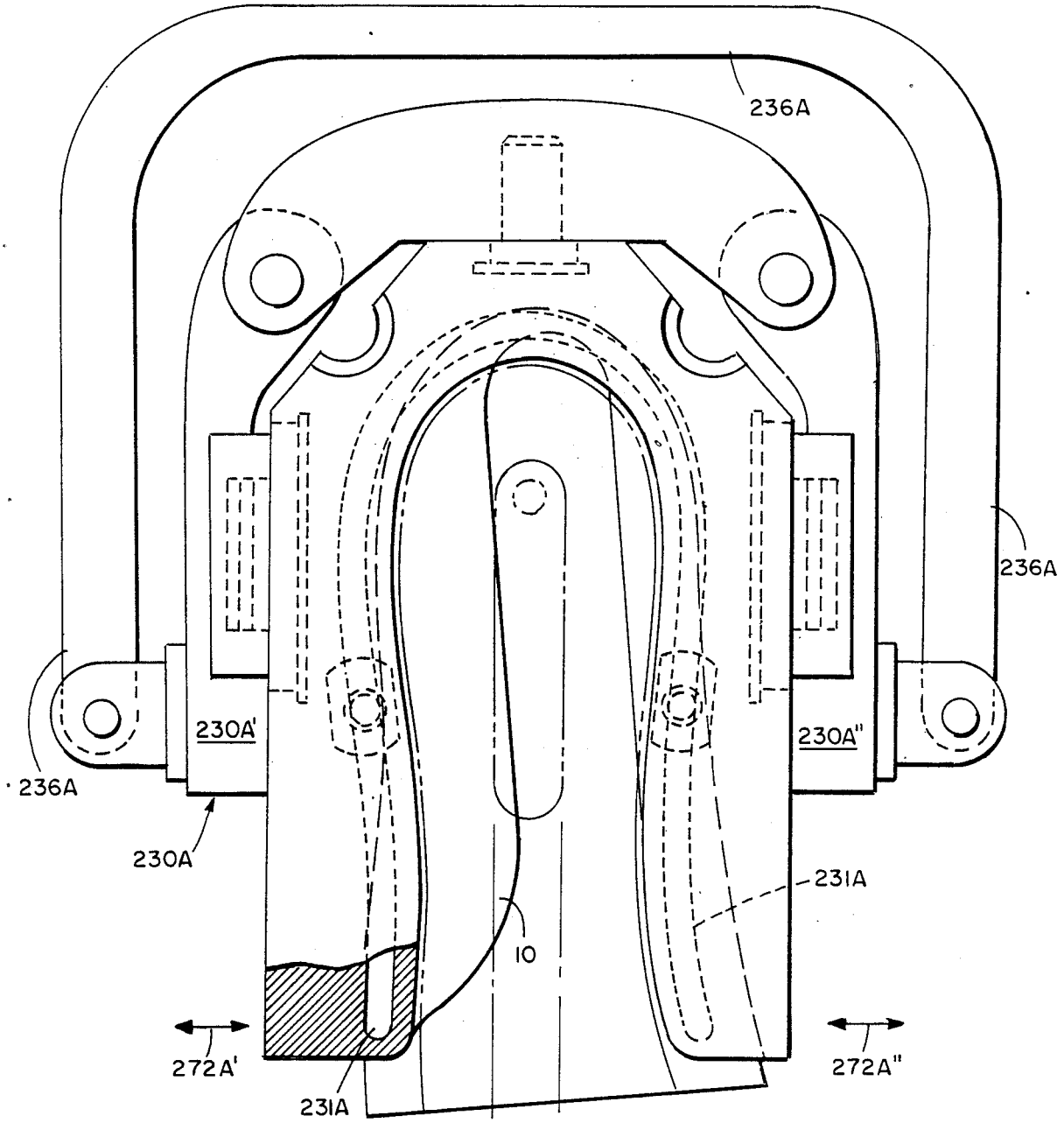
FIG. 8 is a plan view, partly cutaway, of a heel pad in the laster of FIG. 1, (and related parts) which heel pad has an internal cavity to receive gas under pressure.
Figure 9:
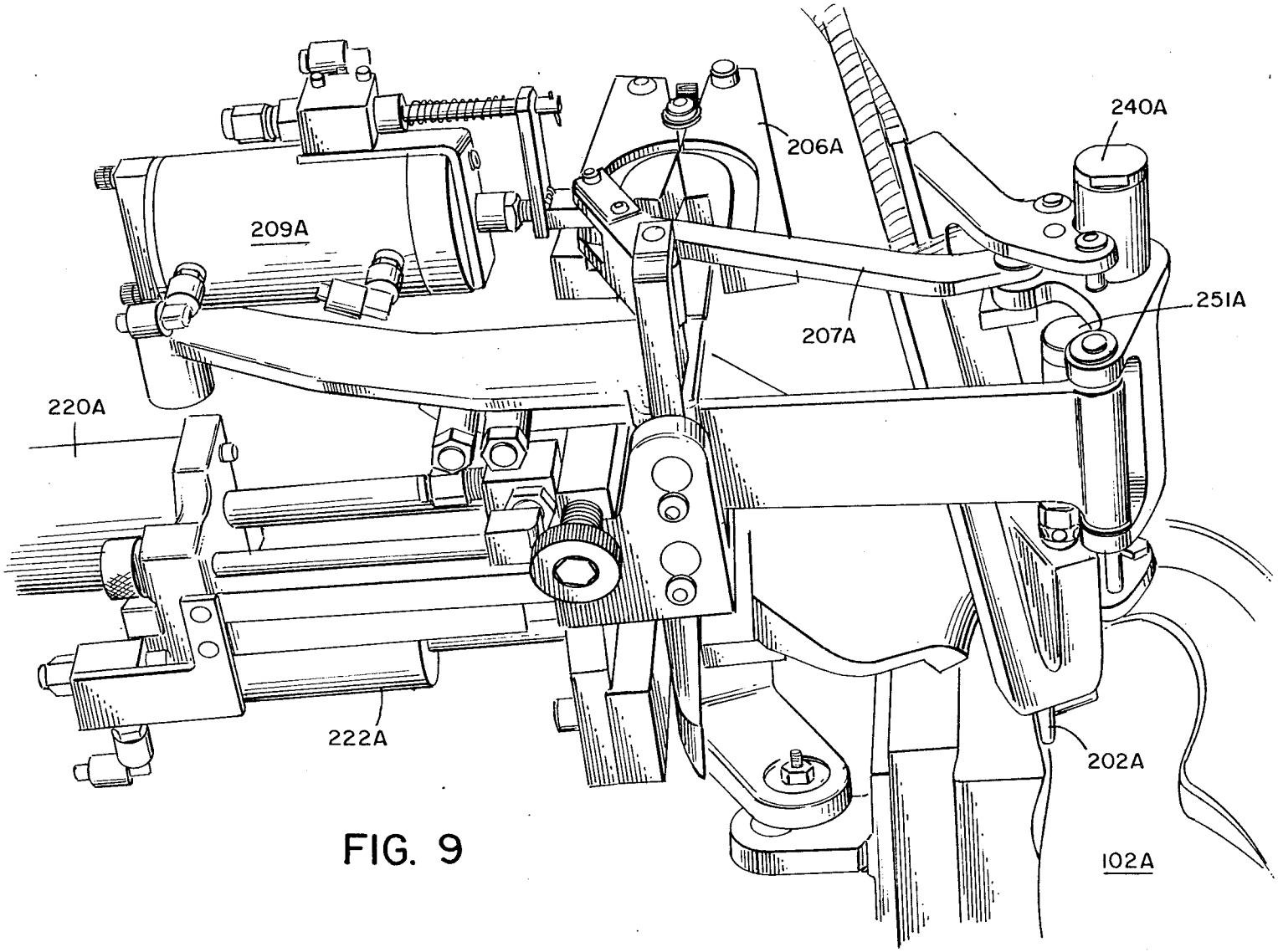
FIGS. 9, 10, 11 and 12 are isometric views of a slight modification of the adhesive application in FIG. 3.

The ideal heel pad for present purposes is inflatable such as the pad 10 in FIG. 8, which is a left pad. The heel pad 10 (right or left) is pressed between the heel part and the shank part of the footwear upper assembly and a rigid, essentially immovable structure 230A, to be pressed in a two-part pressing operation, between the structure 230A and the upper: first the heel pad 10, deflated, is pressed toward the last, as do more conventional heel pads, and second the pad 10 is internally inflated to press the pad inner surface intimately into contact with the upper and to press the upper toward the last and in intimate contact therewith, i.e., to remove any voids between the upper and the last. The inner surface of the heel pad 10 conforms to the shape of the heel part and shank part of the last. The heel pad 10 has an internal air cavity 231A that follows the contour of the inner surface of the pad which is in contact with the upper. This inner cavity 231A is about one-sixteenth inch in cross dimension; it is first without internal air pressure or deflated and is pressed against the upper to press the upper between the pad and the last; then the pad 10 is inflated by air from an external source. Inflating the pad 10 causes the pad to press the upper against and onto the last to press out any unpressed regions of the upper. Thus, according the present teaching, the pad 10 in the machine 101 is operated in a two-step operation: in the first step the deflated pad 10 is pressed unto the upper by pivotal legs 230A' and 230A" (see arrows 272A' and 272A" in FIG. 8) of a mechanical U-shaped member 230A (e.g., metal castings) which legs 230A' and 230A" are pivoted by a yoke 236A to press the pad unto the last (these structures are well known in this art, as are inflatable pads, but not in the two-step type operation). The pad 10 while it is so pressed is inflated by introducing air from an outside source into the cavity 231A which further presses onto the upper at the heel region (and typically the shank region) toward and unto the last.

According to the present teaching, the machine 101 is capable of applying high—very high—bedding force between the wiped margin 107 and the insole 105. That bedding force is between about 200 and 900 pounds. That bedding force is possible, in the machine 101, because the bedding force is achieved by the wipers 8B(8A) and 9B(9A), and because the wipers 8B(8A) and 9B(9A) are structured to mechanically transmit the bedding force directly to the frame 108 of the machine 101, as distinguished from earlier machines. According to this teaching forces between the wipers and the upper assembly 102, in the course of bedding, are transmitted mostly about one-for-one to the frame 108 through head slides 17B(17A) and 18B(18A), whereas in earlier machines that force was somewhat magnified by a lever arm multiplier: rod ways that could bend under the large bedding forces. The rod ways have not been included in the machine 101 and the leverages now present have been greatly reduced so that the bedding forces and the reaction forces onto the frame 108 bear, about, one-for-one relationship. (But see Ser. No.278,981, Becka et al.)

Bedding is achieved by an air cylinder 16B(16A) which initially applies a small plus-Z force to raise the upper assembly into contact with the holdown 3B(3A)—to establish the wiping plane—and, later, a much larger plus-Z force between about 250 pounds and 900 pounds to effect bedding. Typically the applied bedding force is about 400 pounds. The aim of the bedding pressure is to apply a high bedding force between the insole of the footwear upper assembly bottom and the wipers, with the margin sandwiched therebetween to overcome the remnant or residual mechanical memory of the upper and to deform the thermally-activated material in the heel of the upper to a new shape. An aspect of this teaching is that of permitting sufficient time for heat to be withdrawn from the heel region of the upper; the time is enlarged by the dual-station aspects of the machine 101 that provides enough lapse time at each station to withdraw heat from the heel region of the upper, whereby the upper at the heel region takes an acceptable set, a fact that is somewhat more important to the Becka et al. application than here.

To summarize somewhat what has been said, the heel region of the upper is typically heated to activate all parts thereof, including a thermally-activated material therein; it is introduced to the spindle pin 2A(2B) of the machine 101 as part of a footwear upper assembly. There then occurs a sequence of events, which somewhat overlap each other (see FIG. 2). The holdown 3A(3B) is pivoted from the rest (or standby) position to its active position slightly above the insole. The spindle 1A(1B) is raised to cause the insole to press onto the holdown 3A(3B). The pincers 5B(5A) and 6B(6A) under low pressure grasp the forward part of the upper and draw or stretch the upper about the heel portion of the last. When—or while—the upper is so drawn or stretched, the pad 10B(10A) is forced into contact and conformance with the heel region of the footwear upper assembly where it applies substantially uniform pressure to force the upper, with the thermally-activated material therein, to take a shape corresponding to the heel portion of the last, while the pad is so engaged in forming the heel portion of the upper. (The pad 10A(10B) and the adhesive applicator mechanism 200A(200B) are moved as a unit.) Typically, at this juncture, the stretching force exerted by the pincers is decreased. An adhesive ribbon is then applied into the region between the upstanding margin and the insole. At that time—and while the pad is in engagement of the heel region of the upper—the wipers wipe the upstanding margin over and onto the insole at the heel portion and the shank region of the footwear upper assembly.

Figure 6C:
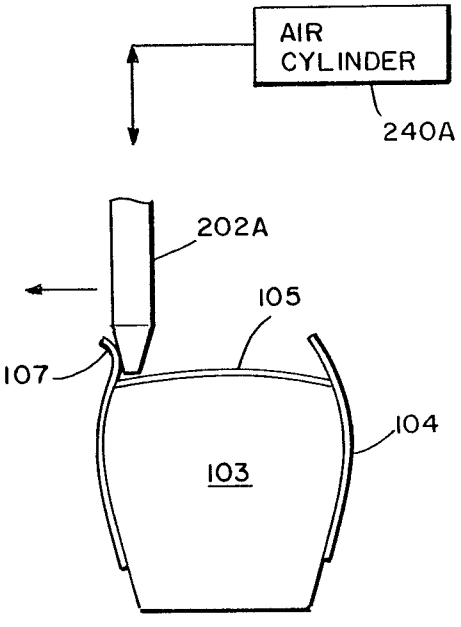
FIGS. 6A, 6B and 6C show diagrammatically an end view (from the toe end thereof) of a footwear upper assembly respectively with an adhesive nozzle disposed above and displaced from the assembly at about the longidudinal axis of the assembly, in close proximity to the assembly but slightly spaced therefrom, and moved toward the edge of the assembly where a U-shaped path of adhesive is applied.
Figure 6B:
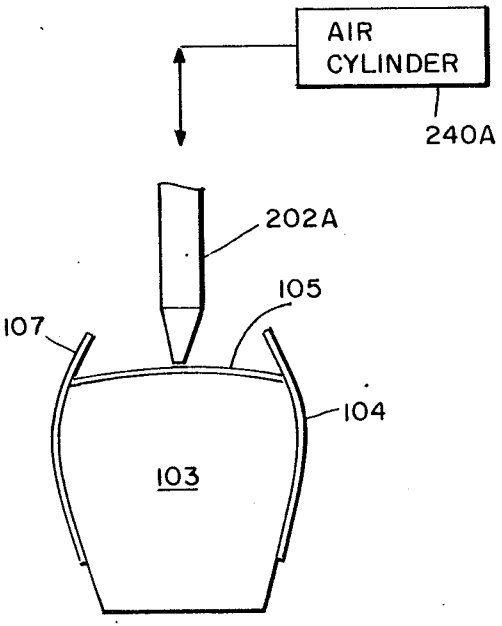
Figure 6A:
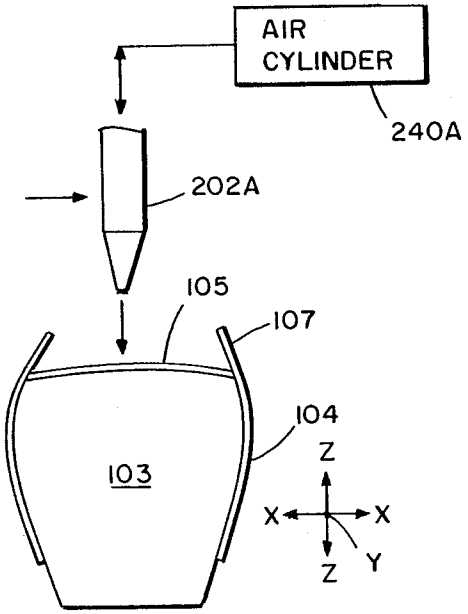
Figure 7:
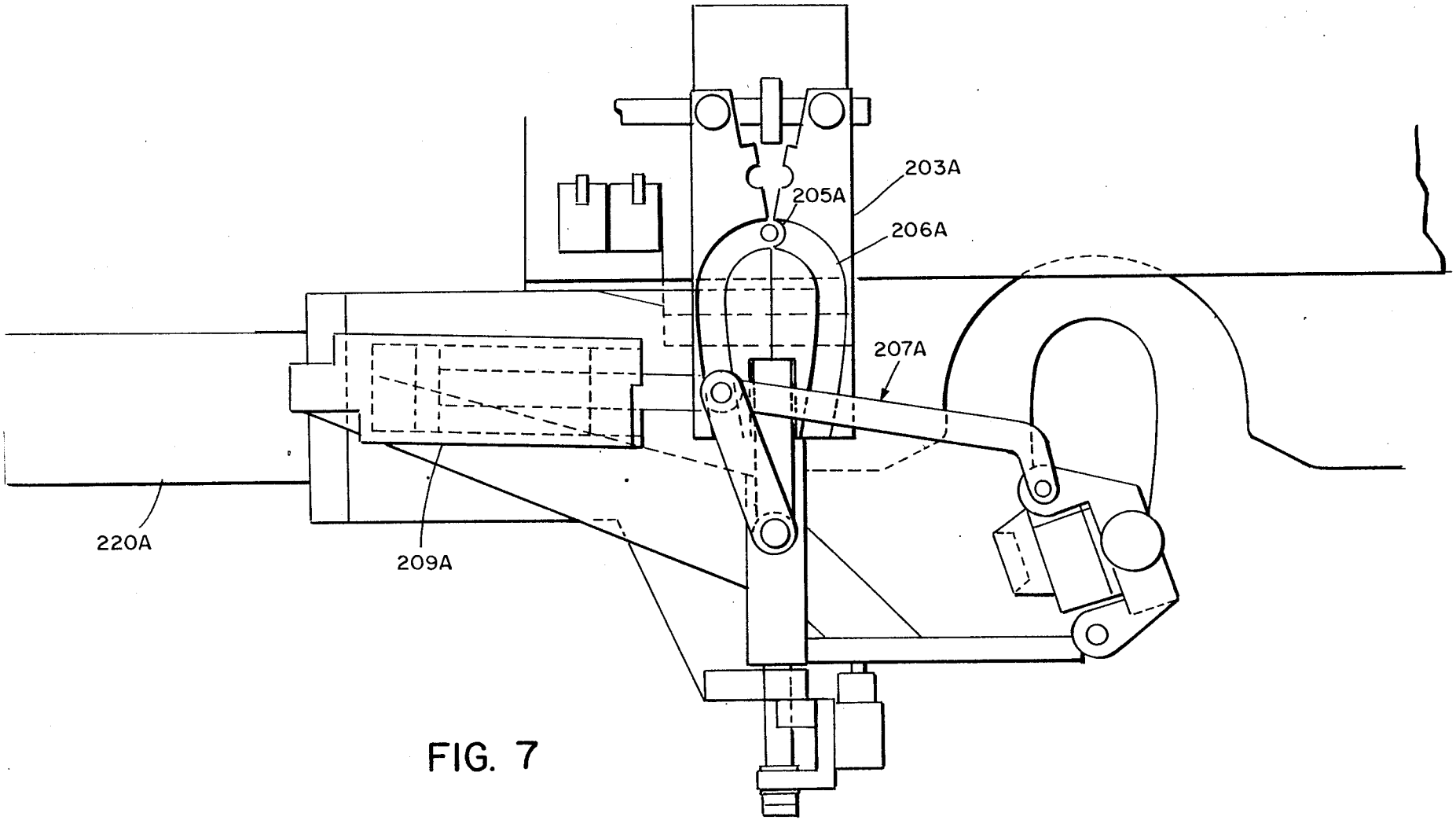
FIG. 7 is a plan view of portions of the cam in earlier figures as well as the coupling structure between the cam and the footwear upper assembly.

In operation, the footwear upper assembly 102 is placed onto the spindle pin 2A(2B); the holdown 3A(3B) is pivoted from a rest position to its active position slightly above the insole 105; the spindle 1(B)1(A) is raised to cause contact between the insole and the holdown; the pincers stretch the upper about the heel part of the last; the heel pad 10A(10B) and the mechanical structure 200A are moved into their active position by the air cylinder 40A(40B); the holdown 3A(3B) is removed; and the mechanical structure 200A is moved from rest position to present the nozzle 202A to the position shown in FIG. 6A. This is accomplished by an air cylinder 220A in FIG. 4 through a structural mechanism 221A to which all the other structural elements in FIG. 4 above the block 221A are mechanically rigidly attached and move in response to movement of the output shaft labeled 224A and movement of the body of the air cylinder 220A which transmits movement forces through the shaft 224A, as now explained. A double acting air cylinder 222A is mechanically attached, in series, to the air cylinder 220A in such a way that the cylinder 222A can move the air cylinder 220A in the direction of double arrow 225A to achieve nozzle positioning from the longitudinal axis of the upper assembly to the margin thereof, as discussed elsewhere herein. The air cylinder 222A also can move longitudinally in the direction of the double arrow 226A.

The mechanical applicator structure 200A is now taken up again with reference mostly to FIG. 4; the structure 200A includes those elements above structural mechanism 221A in FIG. 4, which elements are secured, as indicated by mechanical line 223A, to the mechanism 221A and are moved thereby from a rest position wherein the nozzle 202A is removed from the insole 105 to an active position just above the insole, as discussed elsewhere herein. The applicator structure 200A includes, also, the air cylinders 220A and 222A discussed below, the latter being the motivators for the structural mechanism 221A—that is, the drivers that move the nozzle and closely related parts to and from the insole, as now addressed.

Movement of the nozzle 202A from its rest position to that shown in FIG. 6A is achieved by extension of the output shaft marked 224A of the air cylinder 220A which moves the structural mechanism 221A, as above discussed. The nozzle 202A is thereby placed in the position shown in FIG. 6A; an air cylinder 240A lowers the nozzle toward the insole, FIG. 6B; and then the nozzle is moved to the left, see FIG. 6C, under the margin of the footwear upper assembly, as now explained.

The bodies of the air cylinders 220A and 222A can move (i.e., on slides) to the left and right as indicated by respective double arrows 225A and 226A. The air cylinder 222A is a double acting back-to-back cylinder (see left shaft 222A' which can move to the left in FIG. 4 and right shaft 222A" which can move independently to right from the shown retracted position in FIG. 4). Let it be assumed that the nozzle 202A is in its rest position away from the insole. The shaft 224A is extended which moves —through the mechanism 221A to which all the other structural elements above the block 221A are mechanically, rigidly attached—the nozzle 202A and closely related parts. The double-acting back-to-back air cylinder 222A is mechanically attached to the air cylinder 220A (see rigid metal plate 227A in FIG. 4) in such a way that the air cylinder 222A can move the air cylinder 220A in the direction of the double arrow 225A to achieve nozzle position from the longitudinal axis of the upper assembly (FIG. 6B) toward or to the margin, for example, as shown in FIG. 6C and discussed elsewhere herein. The air cylinder 222A can, as noted, also move longitudinally in the directions of the double arrow 226A by extension of its shafts 222A' and 222A" (along slides, not shown in FIG. 4). All such movement (arrows 225A and 226A) is applied to the machine 101 through the shaft 222A", as is indicated by the diagrammatic grounding symbol in FIG. 4.

To start the cementing cycle, the shaft 224A is extended as noted to place the nozzle 202A in the position shown in FIG. 6A,the shafts 222A' and 222A" being retracted. The nozzle is then lowered to the position shown in FIG. 6B; the shaft 222A' is extended moving the nozzle 202A under the margin, as shown in FIG. 6C. Then adhesive is applied as the nozzle traces the cement path in the manner described above. The shaft 224A is retracted removing the nozzle from the work area, and the upper is wiped and then removed from the machine 101. Movement of the nozzle is clockwise from the start to finish position in FIG. 4; then the nozzle is retracted. At the start of the next cycle, both shafts 222A' and 222A" are extended; simultaneously, the shaft 224A is extended to place the nozzle at the broken position of FIG. 4 and in the equivalent of the position in FIG. 6A. The nozzle is lowered, like FIG. 6B. The shaft 222A' is retracted to move the nozzle under the margin (i.e., the margin opposite that shown in FIG. 6C).

Figure 2:
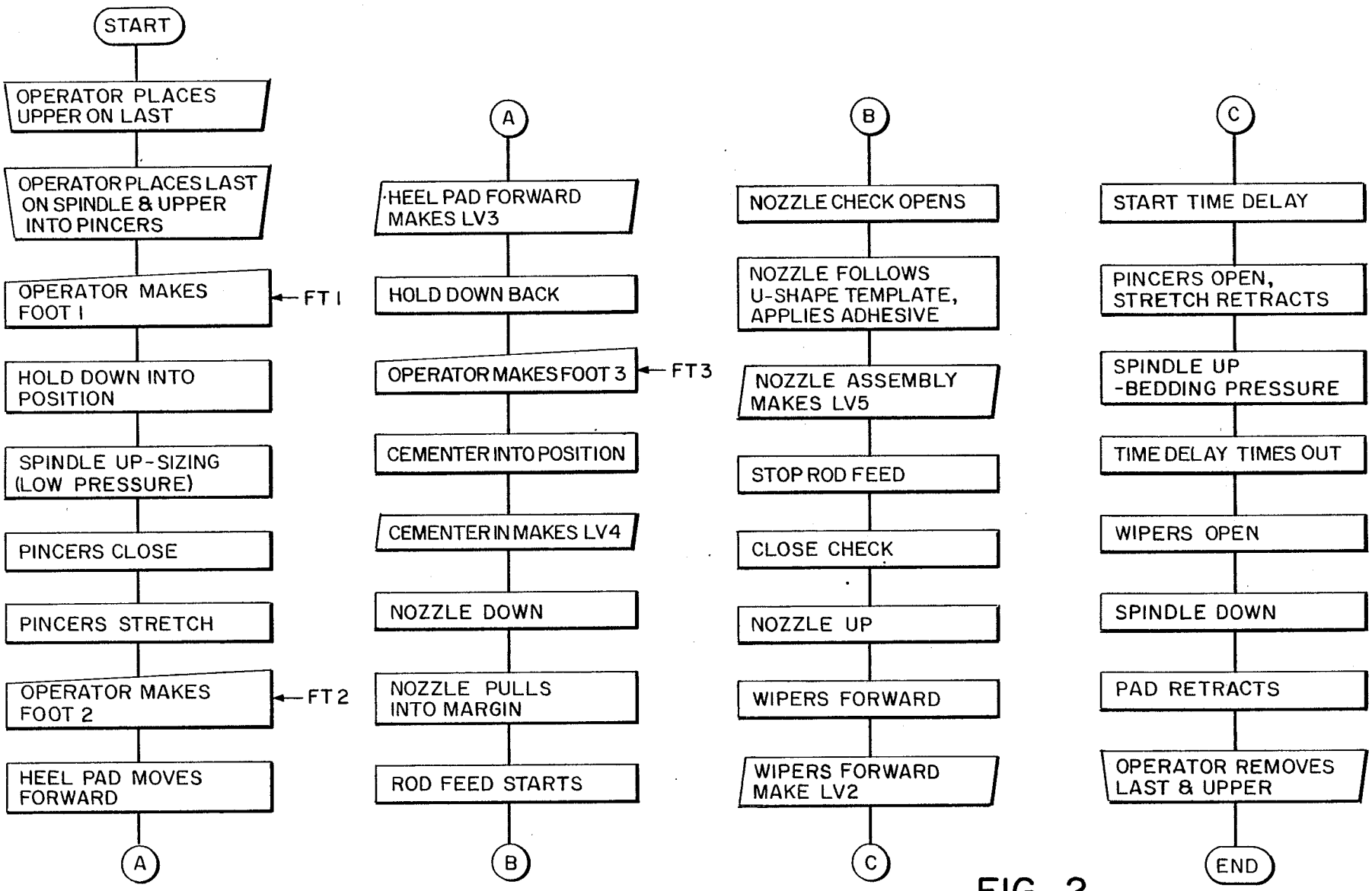
FIG. 2 is a sequence flow chart of the machine in FIG. 1.
Figure 3:
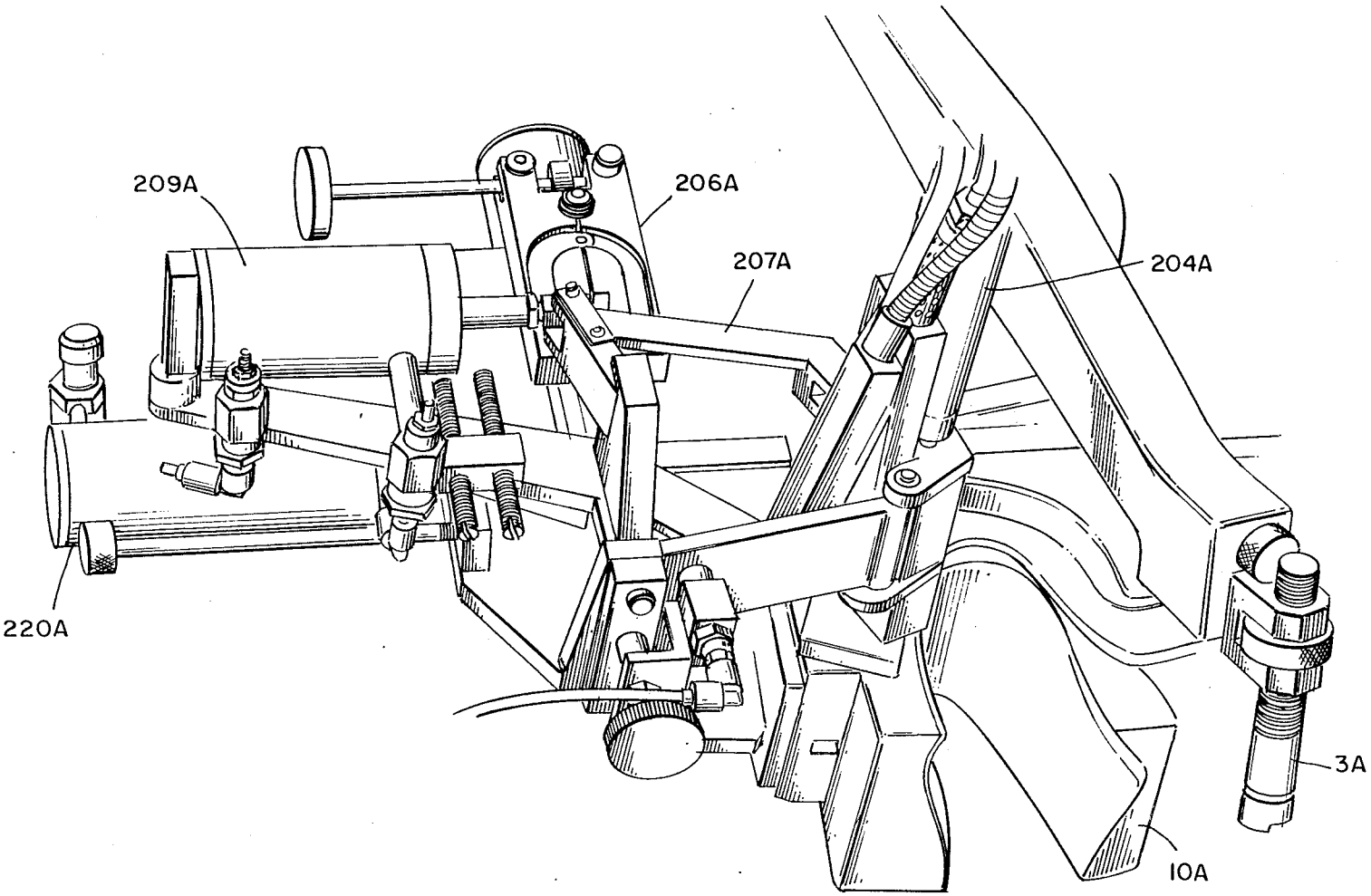
FIG. 3 is an isometric partial view of the left side adhesive applicator in FIG. 1.

A few more matters addressed generally earlier and in FIG. 2 are now taken up. Inputs "FT" in FIG. 2 designate inputs of the pedal labeled 12 in FIG. 1. Knobs 19B(19A), 20B(20A), 21B(21A) and 22B(22A) are connected to—or are part of—threaded rods and serve to adjust pincers height, 19B(19A), 20B(20A), fine adjustment of pincers width 21B(21A) and offset of the toe support 64B(64A) for left and right shoes, 22B(22A). Movement of the pincers in the minus Y-direction to achieve stretching or drawing of the heel part about the heel portion of the last is achieved by an air cylinder 24B(24A) through appropriate mechanical pivotal linkages; it should be noted that FT#1 in FIG. 2 results in low pressure initial stretching and FT#2 results in high-pressure ultimate stretching, as above indicated. A threaded wiper adjustment knob 13B(13) adjusts fore-aft wiper positioning; air cylinders 25B(25A), through appropriate linkages, pivot the wipers in wiping action, the stroke of wiper pivotal action in wiping being controlled by a threaded knob 26B(26A). The air cylinder 40B(40A) drives the pad 10B(10A) through linkage 30B(30A) to perform the functions above described. A sizing drive motor 32B (the other motor is not shown) adjusts the machine parts along slides 36B(36A) and 37B(37A) to accommodate various sizes; it, 32B, is a dc motor. Another dc motor 34B(34A) adjusts for varying heel height of footwear, again through appropriate linkages. The pincers 5B(5A) and 6B(6A) are part of the pincers and toe support assembly, which includes the toe support 64B(64A), structured to move as a unit toward and away from the spindle 1B(1A) to adjust for size of the footwear upper assembly 102, movement as a unit serving to maintain the bottom of the footwear upper assembly in the plane of wiping.

A few further comments are in order. The thermally-activated counter material in the heel part of the upper has a thermally-activated adhesive on each major surface thereof; the adhesive becomes tacky when heated above a threshold temperature (about 240° F. to 280° F.; and this is known) and becomes adherent below that threshold temperature (it is adherent at room temperature). The heel of the upper, the thermally-activated material and the lining of the upper are thus formed, when cooled, into a laminate which retains its formed contour (i.e., by the machine 101) at room temperature. The inventor has found that the laminate can be formed in and by the machine 101.

Figure 10:
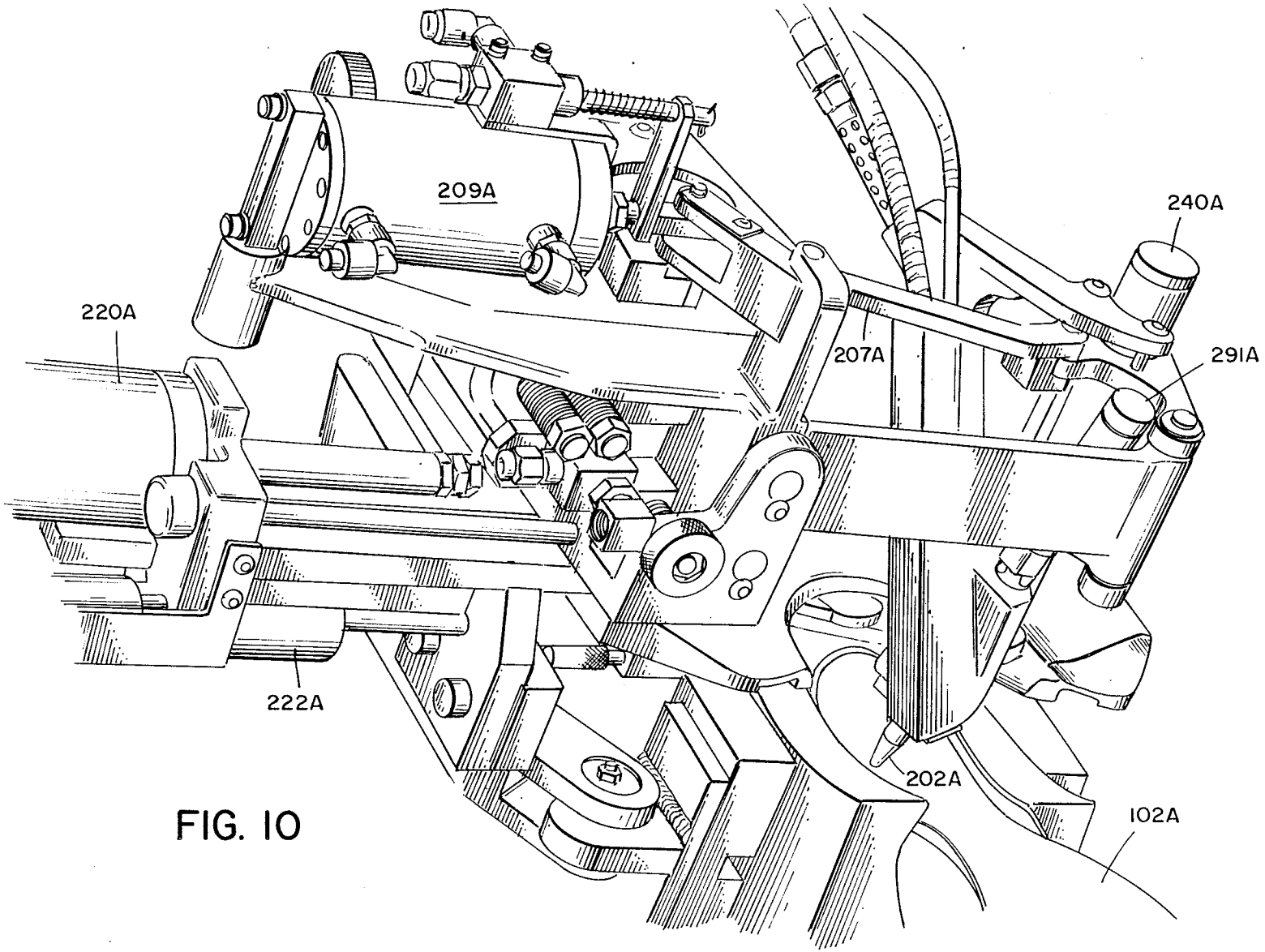
Figure 11:
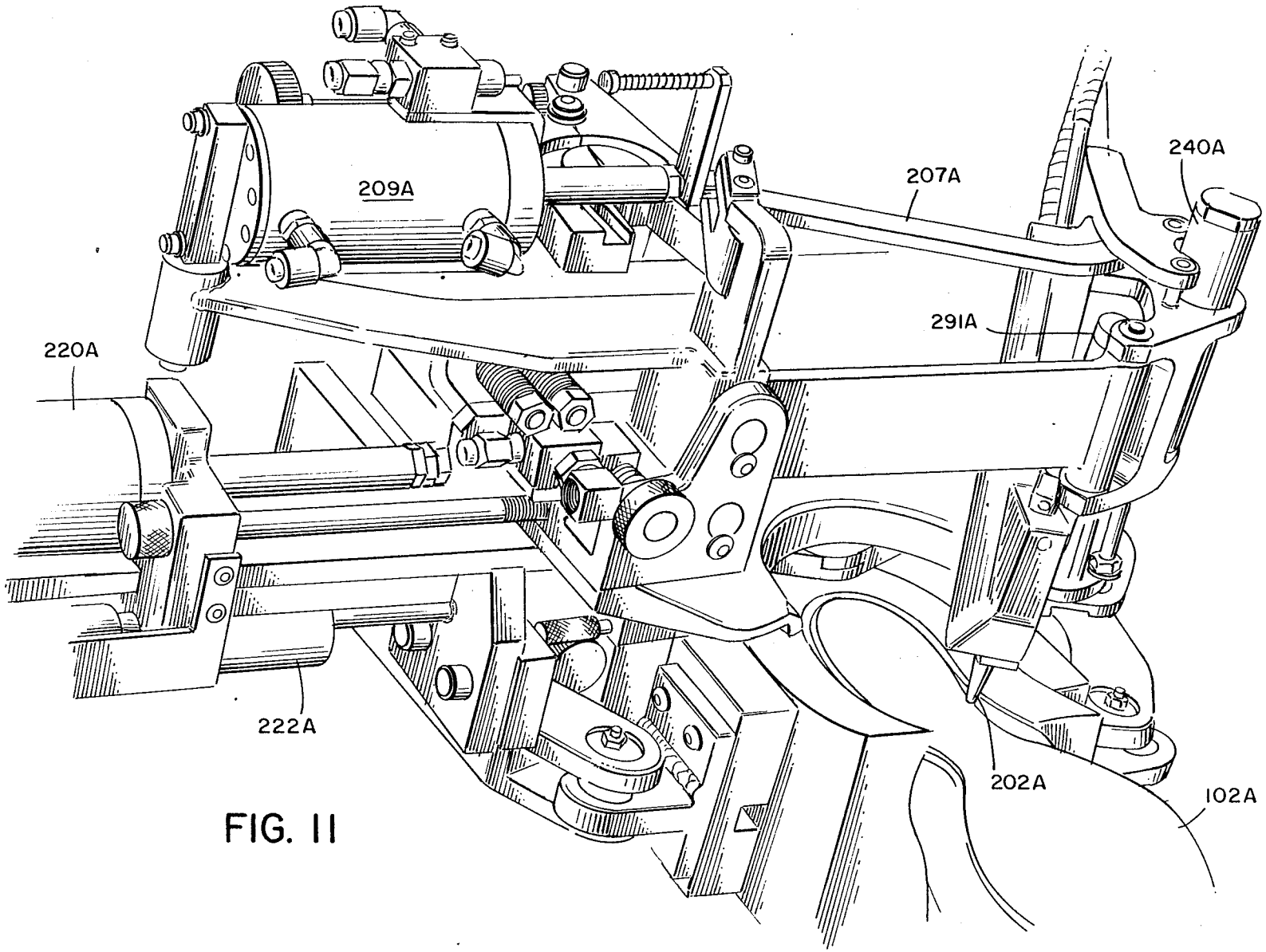
Figure 12:
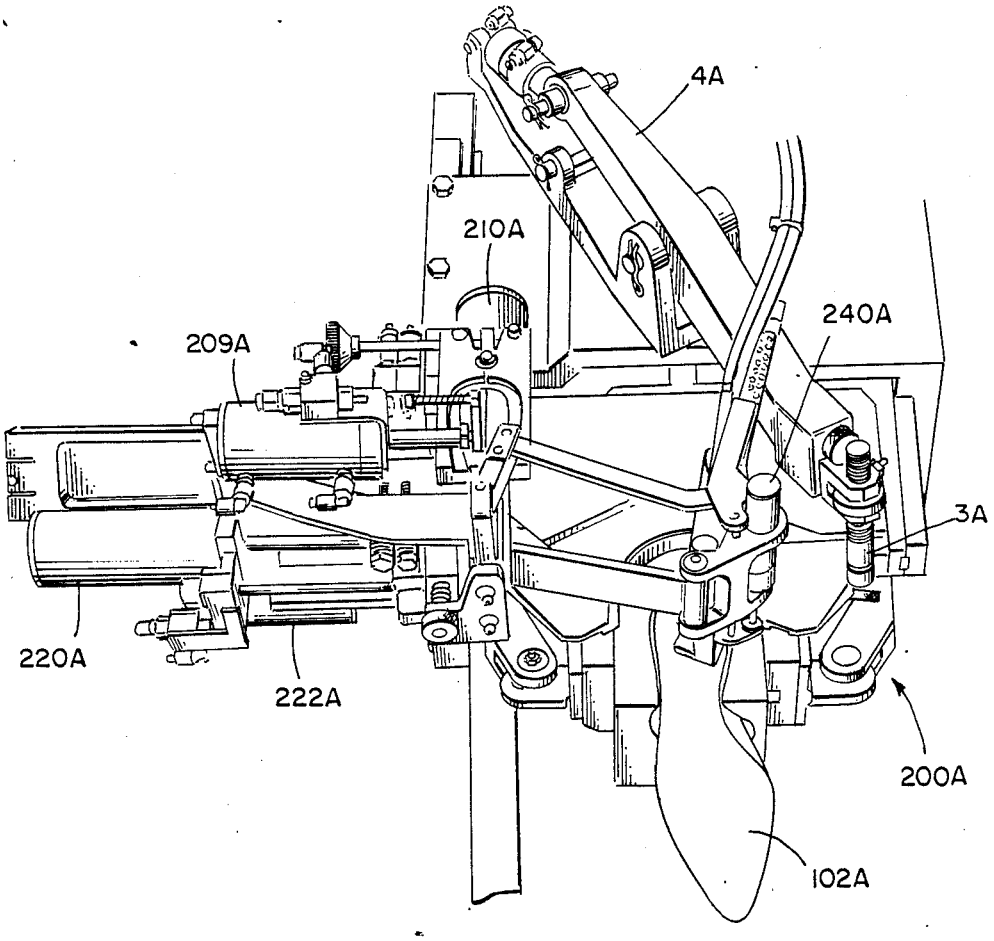

Only one nozzle, the nozzle 202A, is shown in the figures. It is presented in a downward orientation and, as is well known in this art, it serves to render an adhesive liquid and to deposit the liquid adhesive as a ribbon onto the upwardly facing insole. The liquid ribbon must be initiated and terminated at fairly sharply defined places. Toward this end, and this is not generally new in the present context (others have used this general type of nozzle), the nozzle 202A has a rod 250A in FIG. 4A that is raised and lowered by and air cylinder 251A respectively to emit and terminate adhesive extrusion. Introduction of adhesive to the nozzle is by mechanisms known in this art; Z-direction positioning of the nozzle 202A is effected by air cylinder 240A. The footwear upper assembly is marked 102A in FIG. 10.

Further modifications of the invention will occur to persons skilled in the art and all such modifications are deemed to be within the scope of the invention as defined by the appended claims.

What is claimed is:

1. A heel laster to receive a footwear upper assembly that includes a last, a footwear upper draped about the last and an insole disposed on the last bottom, said heel laster being constructed to press and form the heel part of the footwear upper assembly about the heel and side parts of the last while leaving a margin that extends outwardly from the insole, forming of the heel part being effected in part by a heel pad, said heel laster comprising:

a spindle and toe support to receive the upper assembly and means to achieve mechanical attachment of the last to the heel laster and the toe support thereof;

means to press the last firmly onto the spindle and the toe support; and mechanical means to apply a bead of adhesive ribbon onto the insole in the heel part thereof, said mechanical means comprising a nozzle and a mechanical tracer mechanism to position the nozzle appropriately with respect to the insole and guide the nozzle along an appropriate adhesive applicator path, said mechanical tracer mechanism comprising a pivotally angularly adjustable U-shaped cam track in an X-Y plane, a linkage which is substantially parallel to said insole at the heel part thereof connected to the nozzle at one end thereof and to a cam follower at the other end thereof such that the cam follower is positioned within the cam track, means connected to propel the cam follower along the track in the X-Y plane, said mechanical tracer mechanism, as a unit, having a predetermined and fixed position relative to the heel pad of the heel laster so as to establish exact longitudinal position of the last to the footwear upper assembly irrespective of last pin position; and means comprising wipers operable to wipe the margin onto the insole whereby the margin is adhered to the insole.

2. A heel laster according to claim 1 in which the mechanical means is operable to place the nozzle initially toward the longitudinal axis of the footwear upper assembly and is operable thereafter to move the nozzle outward toward the edge of the footwear upper assembly to apply an adhesive ribbon there and beneath the margin.

3. A heel laster according to claim 1 in which the heel pad is an inflatable heel pad that is pressed between the heel part and side parts of the footwear upper assembly and a rigid, essentially immovable structure, to be pressed in a two-part pressing operation between the essentially immovable structure and the upper, first with the heel pad non-inflated to press the upper toward the last and second with the pad internally inflated to press the pad intimately into contact with the upper and to press the upper toward the last and in intimate contact therewith.

4. A heel according to claim 3 that includes two-step means to press the pad against the last, in the first step the uninflated pad is pressed against the upper and in the second step the pad is inflated to press the heel and side portions of the upper of the footwear upper assembly against the last to provide a smooth-surfaced upper.

5. A heel laster according to claim 1 in which the inner surface of the heel pad conforms to the shape of the heel part and side part of the last and which has an internal air cavity that follows the contour of the inner surface of the pad which is in contact with said upper.

6. A heel laster according to claim 1 in which the mechanical tracer mechanism is a panagraph assembly.

7. A heel laster according to claim 6 in which the nozzle has a needle-valve type shutoff which is turned on and off by a pneumatic cylinder thereby to achieve instantaneous shutoff of cement feed.

8. A heel laster to receive a footwear upper assembly that includes a last, a footwear upper draped about the last and an insole disposed on the last bottom, said heel laster being adapted to form and last the heel part of the upper which has a margin that extends outwardly from the insole, forming of the heel part being effected, in part by a heel pad, said heel laster comprising:

a support to receive the upper assembly and achieve mechanical attachment of the last to the heel laster;

means to press the last firmly onto the support; and mechanical means to apply adhesive in the region between the margin and the insole in the heel part of the footwear upper assembly, said mechanical means comprising an adhesive emitter and a mechanical tracer mechanism operable to position the adhesive emitter appropriately with respect to the insole and to guide the adhesive along an appropriate adhesive applicator path, said mechanical tracer mechanism comprising a U-shaped cam track, a linkage connected to the adhesive emitter at one end thereof and to a cam follower at the other end thereof such that the cam follower is positioned within the cam track, driver means to propel the cam follower along the track, said mechanical tracer mechanism, as a unit, having a predetermined and fixed geometrical longitudinal position relative to the heel pad of the heel laster; and means comprising wipers operable to wipe the margin onto the insole whereby the margin is adhered to the insole.

9. A method of heel lasting of a footwear upper assembly that includes a last, a footwear upper draped about the last and an insole disposed on the last bottom, to form the heel part of the upper having a margin that extends outwardly from the insole, said method comprising the sequential and somewhat overlapping steps:

receiving the upper assembly with a preheated upper thereon by a spindle;

pressing the last with the preheated upper thereon firmly onto the spindle;

grasping the upper at its toe or forward region and drawing the preheated upper in the toe direction of the footwear upper assembly to stretch the heel part of the heated upper about the heel portion of the last;

while the heel part of the upper is thus stretched about the heel portion of the last, applying a pad adapted to exert a substantially uniform pressure to form or shape the upper about the heel portion of the last, said pad being moved forward from a retracted position behind the heel part to contact the heel part;

providing a mechanical structure that includes an adhesive emitter to apply an adhesive in the region between the margin and the insole in the heel part of the footwear upper assembly, said mechanical structure further including a mechanical tracer mechanism operable to position the adhesive emitter appropriately with respect to the insole and to guide the adhesive along an appropriate adhesive applicator path, said mechanical tracer mechanism comprising a U-shaped cam track, a linkage connected to the adhesive emitter at one end thereof and to a cam follower at the other end thereon such that the cam follower is positioned within the cam U-shaped track;

moving the mechanical structure simultaneously with the pad, as a unit, from the retracted position forward, then moving the adhesive emitter from a retracted position away from the insole to a position slightly removed from the insole, and then moving the adhesive emitter along a U-shaped path, that corresponds to the cam U-shaped path and as a consequence of the follower moving along the U-shaped track, about the heel region and emitting adhesive onto the insole in the heel region thereof along the U-shaped path;

moving the adhesive emitter away from the insole; and wiping the heel part of the heated upper.

10. A method of lasting according to claim 9 in which cam track is pivotally movable about a pivot at the neck of the U and that includes pivoting the cam track at said neck to adjust for varying footwear sizes and/or styles.

11. A method according to claim 10 in which the heel pad is an inflatable pad, said method comprising applying the inflatable heel pad in a two-step pressing operation wherein first the pad is pressed, deflated about the heel part to press the upper toward the last and second the heel pad is internally inflated to press the heel pad inner surface into intimate contact with the footwear upper asssembly to remove any voids between the upper and the last.

* * * * *